US007441287B2

(12) United States Patent
Zheng

(10) Patent No.: US 7,441,287 B2
(45) Date of Patent: Oct. 28, 2008

(54) COLLAPSIBLE HAMMOCK STAND

(75) Inventor: Edward Zheng, Chino Hills, CA (US)

(73) Assignee: Tofasco of America, Inc., Laverne, CA (US)

( * ) Notice: Subject to any disclaimer, the term of this patent is extended or adjusted under 35 U.S.C. 154(b) by 0 days.

(21) Appl. No.: 10/532,377

(22) PCT Filed: Nov. 20, 2002

(86) PCT No.: PCT/US02/37450

§ 371 (c)(1),
(2), (4) Date: Apr. 21, 2005

(87) PCT Pub. No.: WO2004/047587

PCT Pub. Date: Jun. 10, 2004

(65) Prior Publication Data

US 2006/0150325 A1 Jul. 13, 2006

(51) Int. Cl.

| | |
|---|---|
| ***A45F 3/24*** | (2006.01) |
| *A45F 3/22* | (2006.01) |
| *A45F 4/08* | (2006.01) |
| *A47C 17/70* | (2006.01) |

(52) U.S. Cl. ..... 5/129; 5/127; 5/120; 5/116

(58) Field of Classification Search ..... 5/127–129, 5/120, 122, 123, 115, 116, 110, 111, 99.1, 5/174, 176.1, 181, 182; 248/444, 460, 136, 248/163.1

See application file for complete search history.

(56) References Cited

U.S. PATENT DOCUMENTS

| | | | | | |
|---|---|---|---|---|---|
| 142,327 | A | * | 9/1873 | Craft | 5/129 |
| 201,074 | A | | 3/1878 | Wheeler | |
| 260,230 | A | | 6/1882 | Parker | |
| 441,507 | A | * | 11/1890 | Sale | 5/129 |
| 630,241 | A | * | 8/1899 | Knapp | 5/129 |
| 838,078 | A | | 12/1906 | Carbaugh | |
| 940,939 | A | * | 11/1909 | Patterson | 5/129 |
| 1,151,495 | A | * | 8/1915 | Menten | 5/122 |
| 1,330,901 | A | * | 2/1920 | Richards | 5/115 |
| 1,439,272 | A | * | 12/1922 | Smith | 5/115 |
| 1,483,979 | A | * | 2/1924 | Luery | 5/115 |
| 1,489,515 | A | * | 4/1924 | Atkinson | 267/182 |
| 1,795,202 | A | * | 3/1931 | Dillingham | 5/129 |
| 2,014,205 | A | * | 9/1935 | Linden | 5/512 |
| 3,206,773 | A | * | 9/1965 | Sarasin | 5/99.1 |
| 3,233,254 | A | * | 2/1966 | Golub et al. | 5/99.1 |
| 3,464,069 | A | * | 9/1969 | Bien | 5/110 |
| 3,474,472 | A | * | 10/1969 | Hamilton | 5/98.1 |
| 4,177,737 | A | * | 12/1979 | Brickman | 108/11 |
| 4,384,379 | A | * | 5/1983 | Yamada | 5/115 |
| 4,483,026 | A | * | 11/1984 | Kassai | 5/99.1 |
| 4,573,224 | A | * | 3/1986 | Saint | 5/99.1 |
| 4,826,241 | A | * | 5/1989 | Barras | 297/16.2 |
| 4,984,768 | A | * | 1/1991 | Kolber et al. | 297/16.1 |
| 5,046,203 | A | | 9/1991 | De Cuadros | |
| 5,097,546 | A | * | 3/1992 | Turner, III | 5/127 |
| 5,197,154 | A | * | 3/1993 | Shamie | 5/99.1 |

(Continued)

*Primary Examiner*—Patricia Engle
*Assistant Examiner*—Jonathan J Liu
(74) *Attorney, Agent, or Firm*—Fish & Associates, PC

(57) ABSTRACT

A hammock stand has a plurality of legs, support rods, and a cross brace that couples at least one leg to at least one of the support rods such that the hammock stand collapses in a single movement.

13 Claims, 3 Drawing Sheets

U.S. PATENT DOCUMENTS 5,392,476 A * 2/1995 Williams ..... 5/127
5,394,574 A * 3/1995 Chuang ..... 5/99.1
5,497,517 A * 3/1996 Wang ..... 5/99.1
5,530,977 A * 7/1996 Wang ..... 5/99.1
5,659,907 A 8/1997 Huang
5,699,997 A * 12/1997 Huang ..... 256/26
5,718,473 A * 2/1998 Lynch, Jr. ..... 297/16.2
5,867,851 A * 2/1999 Mariol et al. ..... 5/99.1
D411,387 S * 6/1999 Zheng ..... D6/392
5,911,653 A * 6/1999 Cheng ..... 5/99.1
5,983,422 A * 11/1999 Bayless ..... 5/120
5,984,406 A * 11/1999 Lee ..... 297/16.2
6,082,813 A * 7/2000 Chen ..... 297/16.2
6,112,757 A * 9/2000 Tseng ..... 135/145
6,125,483 A * 10/2000 Stroud et al. ..... 5/99.1
6,134,727 A * 10/2000 Hwang ..... 5/114
6,170,907 B1 * 1/2001 Tsai ..... 297/16.1
6,247,749 B1 * 6/2001 Yu ..... 297/16.2
6,317,907 B1 * 11/2001 Wang ..... 5/99.1
6,322,138 B1 * 11/2001 Tang ..... 297/45
6,336,234 B1 * 1/2002 Kuo ..... 5/99.1
6,446,282 B1 * 9/2002 Wu ..... 5/115
6,454,348 B1 * 9/2002 Wu ..... 297/16.2
6,467,109 B1 * 10/2002 Wu ..... 5/120
6,564,402 B1 * 5/2003 Lin ..... 5/115
6,581,223 B1 * 6/2003 Wang ..... 5/174
D498,088 S * 11/2004 Tsang ..... D6/484
6,865,756 B2 * 3/2005 Clapper et al. ..... 5/99.1

* cited by examiner

- Prior Art -

- Prior Art -

COLLAPSIBLE HAMMOCK STAND

FIELD OF THE INVENTION

The field of the invention is collapsible furniture, especially as it relates to collapsible hammock stands.

BACKGROUND OF THE INVENTION

Hammocks enjoy great popularity in indoor as well as outdoor settings, and depending on the particular locale and/or type of use, may be set up in a permanent or temporary manner. For example, where a hammock is permanently set up on a patio, hooks or other fasteners may be installed to a post or in a wall to fasten the hammock. Alternatively, a hammock may be fixed to a tree by tying or otherwise coupling a tether to the tree.

On the other hand, where a hammock is temporarily used (e.g., for only part of one day), or where permanent attachment of the hammock to a support is not desirable or possible, a hammock may be supported by a hammock stand. There are numerous hammock stands known in the art, however, all or almost all of them suffer from one or more disadvantage. For example, various retailers offer hammock stands with an arched center beam having two or more legs that support the center beam off the ground (see Prior Art FIG. 1). Hammock stands with an arched center beam are often esthetically pleasing and provide relatively good stability. However, when a person inadvertently looses balance and falls off the support, serious injury may occur due-to the position of the center beam.

To avoid at least some of the problems with a center beam, tubular assemblies may be employed in which the corresponding end portions of two substantially parallel tubes are coupled to each other via a V-shaped connector in which the tip of the V-shape points upwards at an angle of about 45 degrees (see Prior Art FIG. 2). However, most tubular assemblies are esthetically less attractive and often require relatively level ground for stable support. Moreover, as hammock stands with center beam, most tubular assemblies are relatively space consuming when not in operation.

To reduce the space requirements of hammock stands, a hammock stand may be reduced to separate front and back portions, wherein both the front and back portions are independently set up, and wherein the front and back portions may further be folded into a more compact configuration. Examples for such hammock stands can be found in U.S. Pat. No. 201,074 to Wheeler, or U.S. Pat. No. 260,230 to Parker, both of which are incorporated by reference herein. While such stands advantageously save space when not supporting the hammock, they typically require multiple points of attachment or contact to the ground to reliably support a person in a hammock.

Alternatively, a hammock stand may also be foldably configured as described in U.S. Pat. No. 838,078 to Carbaugh, wherein a foldable frame is secured with a pair of diagonal braces. While such foldable frames allow a side-to-side reduction in space, such frames do generally not allow for both side-to-side and front-to-back folding operation. Moreover, before an operator can fold such frames, the diagonal braces typically need to be removed. In still further known configurations, hammock frames may also be collapsed. For example, U.S. Pat. No. 5,659,907 to Huang and U.S. Pat. No. 5,983,422 to Bayless describe a configuration in which the hammock frame has a foldable center beam with foldable angled support structures. Alternatively, a collapsible hammock frame may also be configured to include a pair of foldable inverted V-shaped stands that are connected to each other with a foldable lateral support as described in U.S. Pat. No. 5,046,203 to de Cuadros.

While such collapsible hammock frames provide at least some space saving when not supporting the hammock, numerous disadvantages still remain. Among other things, all or almost all of the known hammock stands still require substantial space when not in operation. Furthermore, folding and unfolding of such hammock stands is often difficult, especially to an inexperienced or physically challenged user. Therefore, there is still a need to provide improved hammock stands.

SUMMARY OF THE INVENTION

The present invention is directed to a collapsible hammock stand with a plurality of legs, support rods, and a cross brace that couples at least one leg to at least one of the support rods such that the hammock stand collapses in a single movement.

In one aspect of the inventive subject matter, contemplated hammock stands have four legs, four support rods, and a pair of cross braces, wherein the legs, the support rods, and the cross braces are coupled to each other such that the hammock stand collapses in a single movement in which two of the four legs approximate each other as two of the support rods pivot towards each other.

Particularly suitable configurations include those in which a first and a second of the four legs are rotatably coupled to each other, and wherein a first support rod is rotatably coupled to the first of the four legs and wherein a second of the support rods is rotatably coupled to the second of the four legs. Such configurations may further include a connector rod that couples the second of the four legs to the first of the support rods. Especially preferred connector rods releasably engage with a support rods and form an obtuse angle with one of four legs when the hammock stand is in an open configuration.

In further contemplated aspects of the inventive subject matter, the cross braces are rotatably coupled to each other to form a pair of cross braces, wherein at least one of the cross braces is rotatably coupled to the first of the four legs, and rotatably and slidably coupled to a third of the support rods. Suitable stands may further comprise a body support that is coupled to at least two of the four support rods, and may still further comprise a flexible element that couples the first of the four legs with a third of the four legs and that facilitates collapsing of the hammock stand when the flexible element is pulled upwards relative to the ground (when the hammock stand is in an open configuration).

In yet another aspect of the inventive subject matter, contemplated hammock stands will have a plurality of legs, a plurality of support rods, and at least one pair of cross braces coupling at least one leg to at least one of the support rods such that the hammock stand collapses in a simultaneous front-to-back and side-to-side motion. In such configurations, it is generally preferred that at least one leg is coupled to at least one support rod via a connector rod.

In particularly preferred configurations, such hammock stands will include four legs, four support rods, and two pairs of cross braces, wherein the first pair of cross braces couples at least one leg to at least one support rod, wherein the second pair of cross braces couples at least another one of the legs and another one of the support rods, and wherein at least two legs are rotatably coupled to each other. At least one of the support rods may be rotatably coupled to at least one of the legs.

In a still further aspect of the inventive subject matter, a hammock stand has a first leg, a second leg, a third leg, and a fourth leg, and further includes a first support rod, a second support rod, a third support rod, and a fourth support rod, wherein the first, second, third, and fourth support rod is rotatably coupled to the first, second, third, and fourth leg, respectively; a first pair of cross braces are rotatably coupled to each other, wherein one of the cross braces is rotatably coupled to the first leg and third support rod and wherein the other cross brace is rotatably coupled to the third leg and first support rod; a second pair of cross braces are rotatably coupled to each other, wherein one of the cross braces is rotatably coupled to the second leg and fourth support rod and wherein the other of the cross braces is rotatably coupled to the fourth leg and second support rod; contemplated hammock stands further include a first connector rod, a second connector rod, a third connector rod, and a fourth connector rod, wherein the first, second, third, and fourth connector rod rotatably couples the first leg and the second support rod, the second leg and the first support rod, the third leg and the fourth support rod, and the fourth leg and the third support rod, respectively.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

Prior Art

Prior Art

DETAILED DESCRIPTION

The inventor has discovered that a hammock stand can be manufactured such that the hammock stand can be collapsed in a single motion. As used herein, the term "collapses in a single movement" or "collapses in a single motion" are used interchangeably and refer to a movement in which a user need not interrupt the collapsing motion to fasten or unfasten a connector. Thus, the term "collapses in a single movement" may also include multiple sub-movements, which may or may not be separated by a pause.

Figure 1:
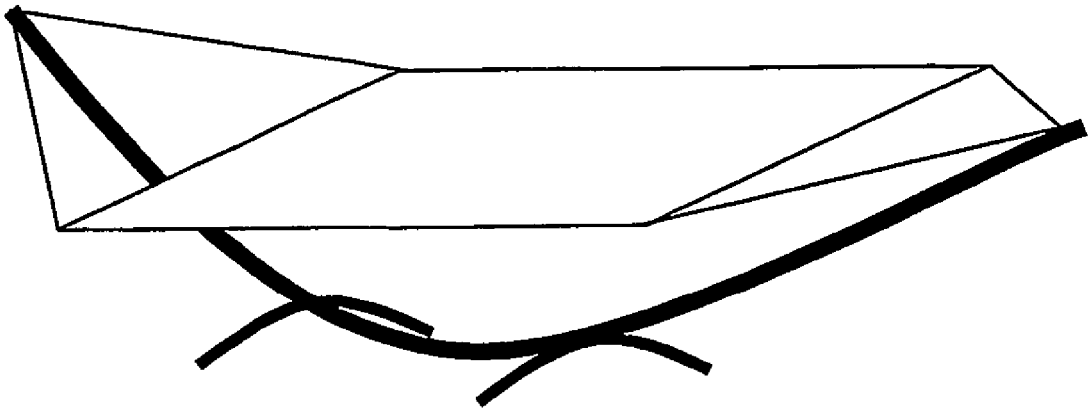
FIG. 1 is a schematic view of a known hammock stand having a center beam.
Figure 2:
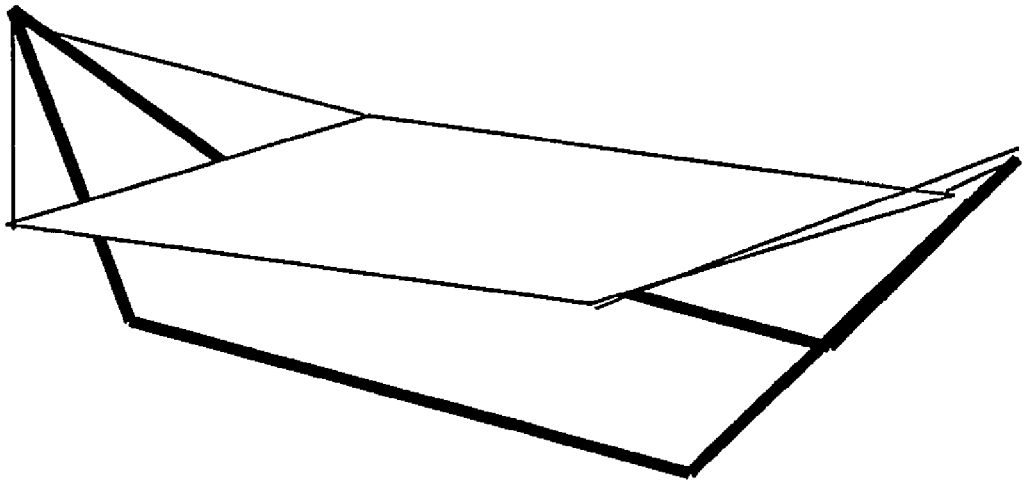
FIG. 2 is a schematic view of a known hammock stand having a tubular assembly with a V-shaped connector.
Figure 3:
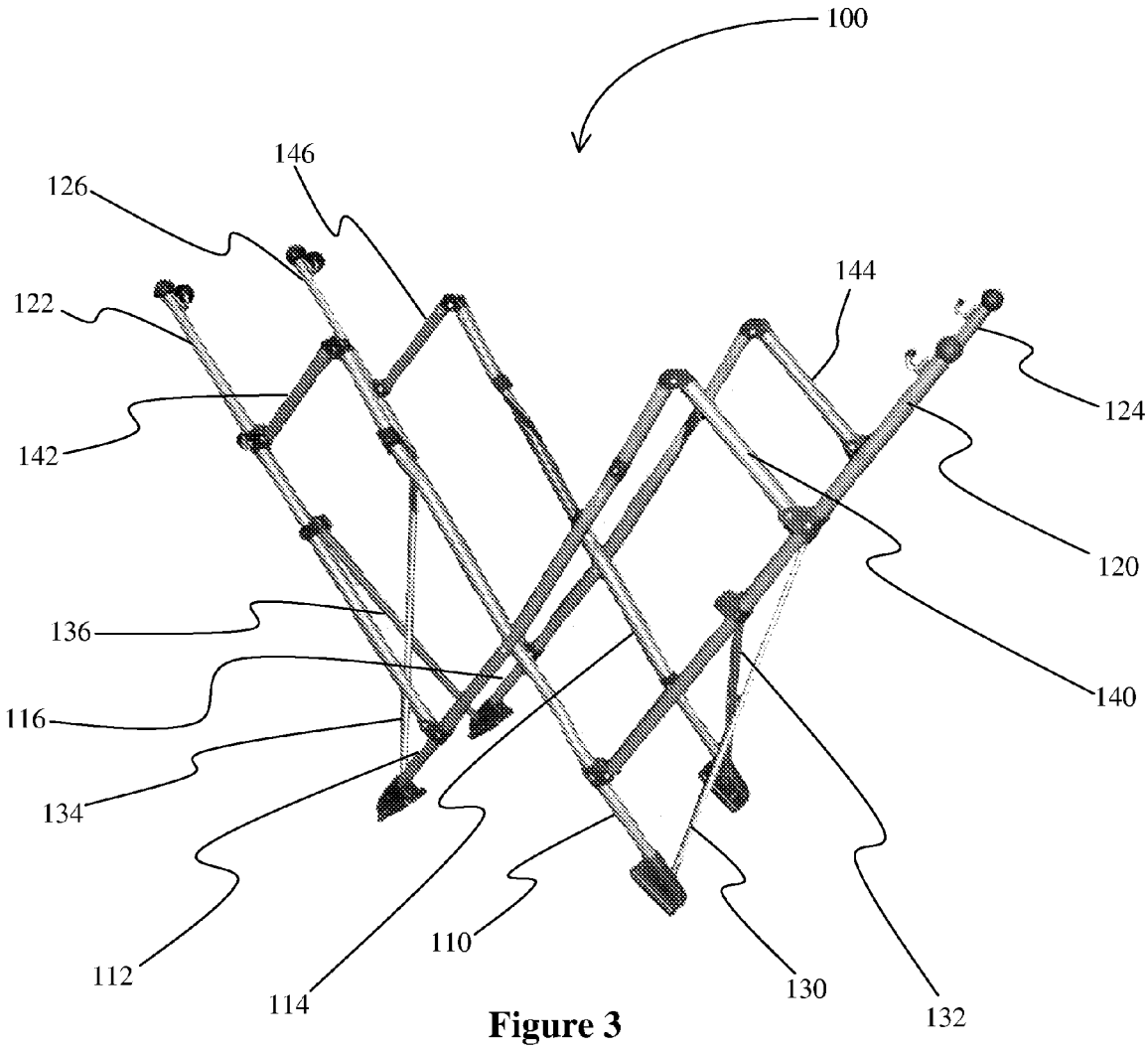
FIG. 3 is a photograph showing a perspective view of a hammock frame in a semi-open configuration according to the inventive subject matter.

In one particularly preferred aspect of the inventive subject matter as shown in FIG. 3, a hammock stand 100 has a first leg 110, a second leg 112, a third leg 114, and a fourth leg 116. First and second legs 110 and 112 are rotatably coupled to each other via a hinge (e.g. rivet), and third and fourth legs 114 and 116 are rotatably coupled to each other via a hinge (e.g., rivet), wherein the point of rotation is approximately in the middle of each of the four legs. The hammock stand further includes a first support rod 120, a second support rod 122, a third support rod 124, and a fourth support rod 126, wherein the first, second, third, and fourth support rod are rotatably coupled via a hinge to the first, second, third, and fourth leg, respectively.

A first pair of cross braces has cross brace 130 and cross brace 132. Cross brace 130 and cross brace 132 are rotatably coupled to each other (point of rotation is substantially in the middle of each cross brace), wherein cross brace 130 is rotatably coupled to the first leg 110 and rotatably and slidably to the third support rod 124, and wherein cross brace 132 is rotatably coupled to the third leg 114 and rotatably and slidably to the first support rod 120. A second pair of cross braces has cross brace 134 and cross brace 136. Cross brace 134 and cross brace 136 are rotatably coupled to each other (point of rotation is substantially in the middle of each cross brace), wherein cross brace 134 is rotatably coupled to the second leg 112 and rotatably and slidably coupled to the fourth support rod 126, and wherein cross brace 136 is rotatably coupled to the fourth leg 116 and rotatably and slidably coupled to the second support rod 122.

Where the cross braces are rotatably coupled to the legs, it is generally preferred that the coupling is via a terminal portion of the legs (e.g., in a pad that contacts the ground). Similarly, where the cross braces are rotatably and slidably coupled to the support rods, it is generally preferred that coupling is via a sliding sleeve that further includes a rotatable connector (e.g., bolt).

Figure 4:
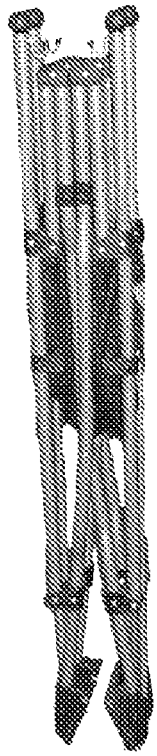
FIG. 4 is a photograph showing a perspective view of a hammock frame in a closed configuration according to the inventive subject matter.
Figure 5:
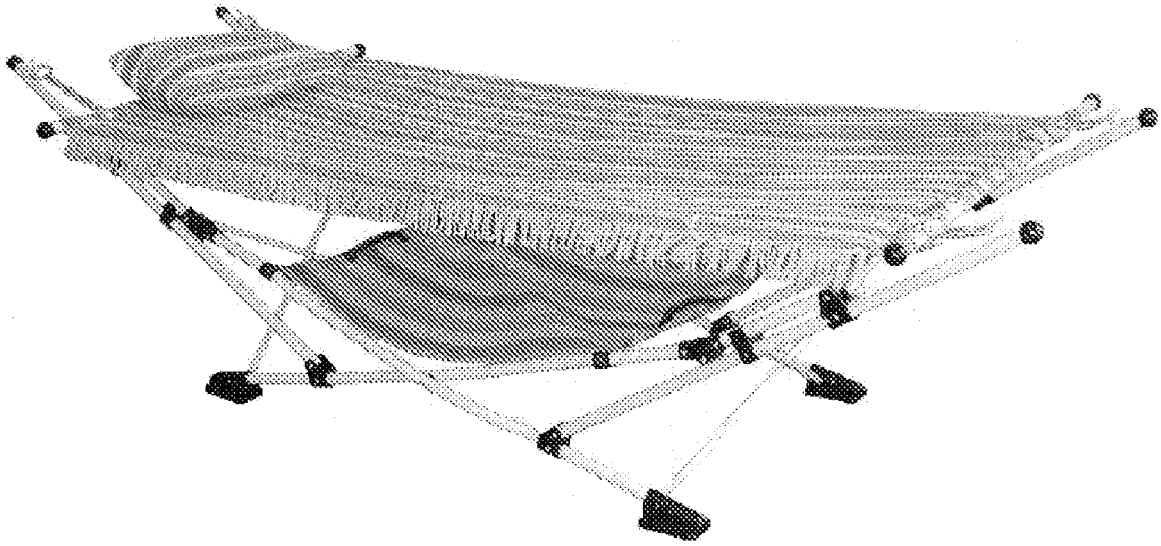
FIG. 5 is a photograph showing a perspective view of a hammock frame with a body support and accessory sheet in an open configuration according to the inventive subject matter.

A first connector rod 140, a second connector rod 142, a third connector rod 144, and a fourth connector rod 146 rotatably couple the first leg 110 and the second support rod 122, the second leg 112 and the first support rod 120, the third leg 114 and the fourth support rod 126, and the fourth leg 116 and the third support rod 124, respectively. It is particularly preferred that one end of the connector rod is rotatably coupled to the leg at (or near) the end that extends beyond the point of rotation and is distal to the ground when the hammock stand is in an open configuration (see FIG. 3). With respect to the other end of the connector rod it is generally preferred that the other end is rotatably coupled to the support rod at a point above the point where the cross brace is rotatably and slidably coupled to the support rod when the hammock stand is in an open configuration. The term "open configuration" as used herein refers to the configuration of the hammock stand in which the ends of the support rods (to which a body support may be attached) are at or near their maximum distance from each other, and in which a user can rest on a body support that is coupled to the hammock stand. Consequently, the term "closed configuration" as used herein refers to the collapsed configuration in which the ends of the support rods are at or near their minimum distance from each other. For further illustration, FIG. 4 depicts an exemplary hammock stand in the closed (or collapsed) configuration.

The end of the support rods 120 to 126 may further include a retainer element that is configured to receive a corresponding attachment element from a body support. Thus, it is generally contemplated that the hammock stand according to the inventive subject matter may temporarily or permanently include a body support, and all known types of body supports are contemplated suitable for use herein. For example, contemplated body supports include rope, fabric, or string-type supports, which may be fabricated from natural and/or synthetic materials. With respect to the size of contemplated body supports, it should be recognized that all sizes are suitable, and especially include sizes adapted to support one or more users (e.g. children or adults).

Depending on the type of body support, it should be appreciated that the attachment element may vary considerably, and suitable attachment elements include ropes, wires, hooks, rings, a stave, etc. Consequently, the nature and size of the retainer element may vary and particularly contemplated retainer elements are those that functionally cooperate with the attachment element to at least temporarily couple the body support to the hammock stand. Thus, contemplated retainer elements include hooks, locks, snaps, etc. Therefore, while any mode of coupling is contemplated, suitable body supports are typically coupled to two, and more typically to four support rods.

In further particularly preferred aspects, contemplated hammock supports will further include a sheet of fabric (optionally including a handle) that is coupled to the first, second, third, and fourth leg (most typically at a point between the point of rotation and the slidable coupling of the cross brace) to facilitate collapsing of the hammock stand when the sheet of fabric is pulled upwards relative to the ground and when the hammock stand is in an open configuration. Alternatively, the sheet may be replaced with a string (which may or may not have a handle) that is coupled to the first and third (and/or second and fourth) leg at a point between the point of rotation and the slidable coupling of the cross brace.

With respect to the legs, support rods, connector rods, and cross braces of contemplated hammock stands, it should be appreciated that all of these elements may be manufactured from various materials, including metals, metal alloys, natural and synthetic polymers, and any reasonable combination thereof. However, it is preferred that the legs, support rods, connector rods, and cross braces are manufactured from black anodized aluminum tubing with a wall strength of about 1/32 inch and an outer diameter of approximately 1/2 inch.

Where one of the legs, support rods, connector rods, and cross braces is rotatably or pivotably coupled to another one of the legs, support rods, connector rods, and cross braces, it is generally contemplated that all known manners of rotatably coupling are suitable for use in conjunction with the teachings presented herein. For example, appropriate manners of rotatably coupling include coupling of two elements via a common axis, coupling via a hinge wherein the hinge may or may not have a slidable connection to another element, coupling via a ball bearing, etc. Similarly, where one of the legs, support rods, connector rods, and cross braces are slidably coupled to another one of the legs, support rods, connector rods, and cross braces, all known slidable couplings are contemplated to be appropriate, and include a sliding sleeve, slide rails, guiding rings, etc. Furthermore, where a slidable coupling is employed, it should also be recognized that the sliding motion may be replaced with a telescoping element. Thus, it should be appreciated contemplated couplings between the legs, support rods, connector rods, and/or cross braces may be rotatable and/or slidable. Alternatively, where rotatable and slidable couplings are less desirable, it is contemplated that temporary couplings may be employed. Suitable temporary couplings include snap connectors, connectors that are secured with a pin or other removable element (e.g., screw, nut, etc.).

However, it should be recognized that preferred couplings will enable a user to collapse the hammock stand in a single motion. Therefore, in one especially preferred aspect of the inventive subject matter, suitable couplings between the cross braces, legs, and support rods (which may or may not include the connector rods) will result in a quad configuration. The term "quad configuration" as used herein refers to a configurations of at least eight elements in which four pairs of elements are (directly or indirectly) pivotably and/or slidably coupled to each other to allow simultaneous movement of all of the eight elements and wherein the two elements of the pair of elements are rotatably coupled to each other (preferably around a point of rotation located in or near the middle of the element).

Consequently, it should be appreciated that a hammock stand may comprise four legs, four support rods, and a pair of cross braces, wherein the legs, the support rods, and the cross braces are coupled to each other such that the hammock stand collapses in a single movement in which two of the four legs approximate each other as two of the support rods pivot towards each other. In particularly preferred configurations (see e.g., FIG. 3), a first and a second of the four legs are rotatably coupled to each other, and in yet further preferred aspects, a first support rod is rotatably coupled to the first of the four legs and a second support rods is rotatably coupled to the second of the four legs, wherein the second of the four legs may be coupled to the first of the support rods via a connector rod.

Where contemplated hammock stands include a connector rod, it is especially preferred that the connector rod releasably engages with a support rod (e.g. via a bracket, and most preferably via a bracket that is coupled to the slidable connector between a support rod and a cross brace). In such configurations, the connector rod and the leg form an obtuse angle when the hammock stand is in an open configuration, thereby greatly increasing the stability of the hammock stand.

In still further preferred configurations, the pair of cross braces is rotatably coupled to each other (e.g., via a point at or near the middle of the cross brace), and at least one of the cross braces is rotatably coupled to one leg, and rotatably and slidably coupled to the support rod that is on the opposite side of the one leg in the hammock stand. With respect to the body support and the flexible element (e.g., sheet of fabric), the same considerations as described above apply.

Therefore, viewed from another perspective, a collapsible hammock stand may have a plurality of legs, a plurality of support rods, and at least one pair of cross braces coupling at least one leg to at least one of the support rods such that the hammock stand collapses simultaneously in a front-to-back and side-to-side motion. In such configurations, it is generally preferred that at least one leg is coupled to at least one support rod via a connector rod, and it is further preferred that such hammock stands include four legs, four support rods, and two pairs of cross braces, wherein the first pair of cross braces couples at least one leg to at least one support rod, wherein the second pair of cross braces couples at least another one of the legs and another one of the support rods, and wherein at least two legs are rotatably coupled to each other (e.g., at least one of the support rods is rotatably coupled to at least one of the legs).

Thus, specific embodiments and applications of collapsible hammock stands have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A hammock stand comprising four legs, four support rods to which a hammock is coupled, and a pair of cross braces, each pair comprising a first and second cross brace that are rotatably coupled to each other via a point of rotation that is in the middle of each cross brace, wherein the legs, and the support rods are coupled to each other on respective ends of the hammock stand via respective cross braces such that the cross braces, without being uncoupled from the legs and support rods and upon folding of the hammock stand produce a movement in which two of the four legs approximate each other in a front-to-back and side-to-side motion as two of the support rods pivot towards each other, and wherein a second of the four legs is coupled to a first of the support rods via a connector rod that releasably engages with the first of the support rods and forms an obtuse angle with the second of the four legs when the hammock stand is in an open configuration.

2. The hammock stand of claim 1 wherein a first and the second of the four legs are rotatably coupled to each other.

3. The hammock stand of claim 2 wherein a first support rod is rotatably coupled to the first of the four legs and wherein a second of the support rods is rotatably coupled to the second of the four legs.

4. The hammock stand of claim 1 wherein at least one of the cross braces is rotatably coupled to the first of the four legs, and rotatably coupled to a third of the support rods.

5. The hammock stand of claim 1 wherein the hammock is coupled to at least two of the four support rods via a hook.

6. The hammock stand of claim 1 further comprising a flexible element that couples the first of the four legs with a third of the four legs and that facilitates collapsing of the hammock stand when the flexible element is pulled upwards relative to the ground and when the hammock stand is in an open configuration.

7. The hammock stand of claim 6 wherein the flexible element comprises a sheet of fabric.

8. The hammock stand of claim 7 wherein the sheet of fabric further comprises a handle.

9. A hammock stand comprising:

a first leg, a second leg, a third leg, and a fourth leg; and further comprising a first support rod, a second support rod, a third support rod, and a fourth support rod, wherein the first, second, third, and fourth support rod are rotatably coupled to the first, second, third, and fourth leg, respectively;

a first pair of cross braces rotatably coupled to each other, wherein one of the first pair of cross braces is rotatably coupled to the first leg and third support rod and wherein the other of the first pair of cross braces is rotatably coupled to the third leg and first support rod;

a second pair of cross braces rotatably coupled to each other, wherein one of the second pair of cross braces is rotatably coupled to the second leg and fourth support rod and wherein the other of the second pair of cross braces is rotatably coupled to the fourth leg and second support rod; and a first connector rod, a second connector rod, a third connector rod, and a fourth connector rod, wherein the first, second, third, and fourth connector rod rotatably couples the first leg and the second support rod, the second leg and the first support rod, the third leg and the fourth support rod, and the fourth leg and the third support rod, respectively.

10. The hammock stand of claim 9 further comprising a hammock that is coupled to the first, second, third, and fourth support rod.

11. The hammock stand of claim 10 further comprising a sheet of fabric coupled to the first, second, third, and fourth leg, and that facilitates collapsing of the hammock stand when the sheet of fabric is pulled upwards relative to the ground and when the hammock stand is in an open configuration.

12. The hammock stand of claim 11 wherein the sheet of fabric further comprises a handle.

13. A hammock stand comprising four legs, four support rods to which a hammock is coupled, and a pair of cross braces, each pair comprising a first and second cross brace that are rotatably coupled to each other via a point of rotation that is in the middle of each cross brace, wherein the legs and the support rods are coupled to each other on respective ends of the hammock stand via respective cross braces such that the cross braces, without being uncoupled from the legs and support rods and upon folding of the hammock stand produce a movement in which two of the four legs approximate each other in a front-to-back and side-to-side motion as two of the support rods pivot towards each other, wherein a second of the four legs is coupled to a first of the support rods via a connector rod, wherein the pair of cross braces are rotatably coupled to each other, and wherein at least one of the cross braces is rotatably coupled to a first of the four legs, and rotatably coupled to a third of the support rods.

* * * * *